United States Patent [19]

DeSantis et al.

[11] 4,328,501

[45] May 4, 1982

[54] SMALL BROADBAND ANTENNAS USING LOSSY MATCHING NETWORKS

[75] Inventors: Charles M. DeSantis, Neptune, N.J.; Albert H. Zannella, Mount Carmel, Pa.; Michael W. Begala, Fairhaven, N.J.; John R. Wills, Ocean Grove, N.J.; Watson P. Czerwinski, Forked River, N.J.

[73] Assignee: The United States of America as represented by the Secretary of the Army, Washington, D.C.

[21] Appl. No.: 142,917

[22] Filed: Apr. 23, 1980

[51] Int. Cl.[3] ..... H01Q 9/36

[52] U.S. Cl. ..... 343/749; 343/861; 343/899

[58] Field of Search ..... 343/860, 861, 828, 899, 343/749

[56] References Cited

U.S. PATENT DOCUMENTS

| | | | |
|---|---|---|---|
| 1,998,960 | 4/1935 | Kaar | 343/860 |
| 2,111,743 | 3/1938 | Blumlein et al. | 343/860 |
| 2,190,436 | 2/1940 | Steinhausen | 343/860 |
| 2,278,531 | 4/1942 | Bushbeck | 343/861 |
| 2,315,170 | 3/1943 | Van Weel | 343/861 |
| 2,541,107 | 2/1951 | Selgin | 343/861 |

*Primary Examiner*—Eli Lieberman

*Attorney, Agent, or Firm*—Nathan Edelberg; Jeremiah G. Murray; Michael C. Sachs

[57] ABSTRACT

A low-profile survivable antenna suitable for military use is described. Despite its small size, which might be one tenth of a wavelength, the antenna has reasonable transmission range for these applications. Very little operator attention is needed in use, since a special matching circuit within the antenna network enables effective impedance matching, over a 3:1 frequency range, without necessity of switching to different matching circuits over different frequency bands. By including resistive components along with other passive inductive or capacitive elements, the reactance of the single matching circuit is made to effectively compensate the antenna's impedance over the entire frequency range. The impedance of the circuit has a decreasing positive reactance which compensates for the decreasing negative reactance, with frequency, of the antenna. Although the transmission efficiency of the matched antenna network is somewhat diminished by resistive losses, it is still satisfactory, and band switching with this matching circuit is completely eliminated. By including a slender whip screwed into the top, the range can be doubled with no further changes. The matching techniques to be described are most easily realized in the HF through VHF range (1-200 MHz).

5 Claims, 17 Drawing Figures

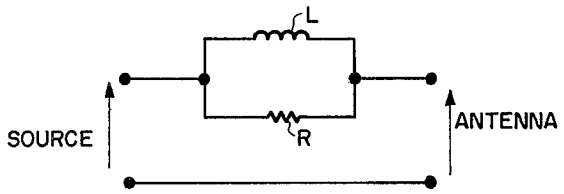
FIG. 1a PARALLEL R/L CIRCUIT, IN SERIES
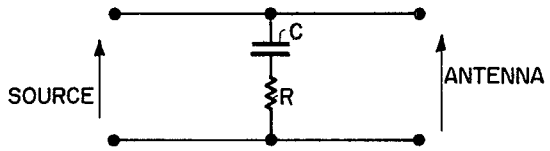
FIG. 1b SERIES R/C CIRCUIT, IN PARALLEL
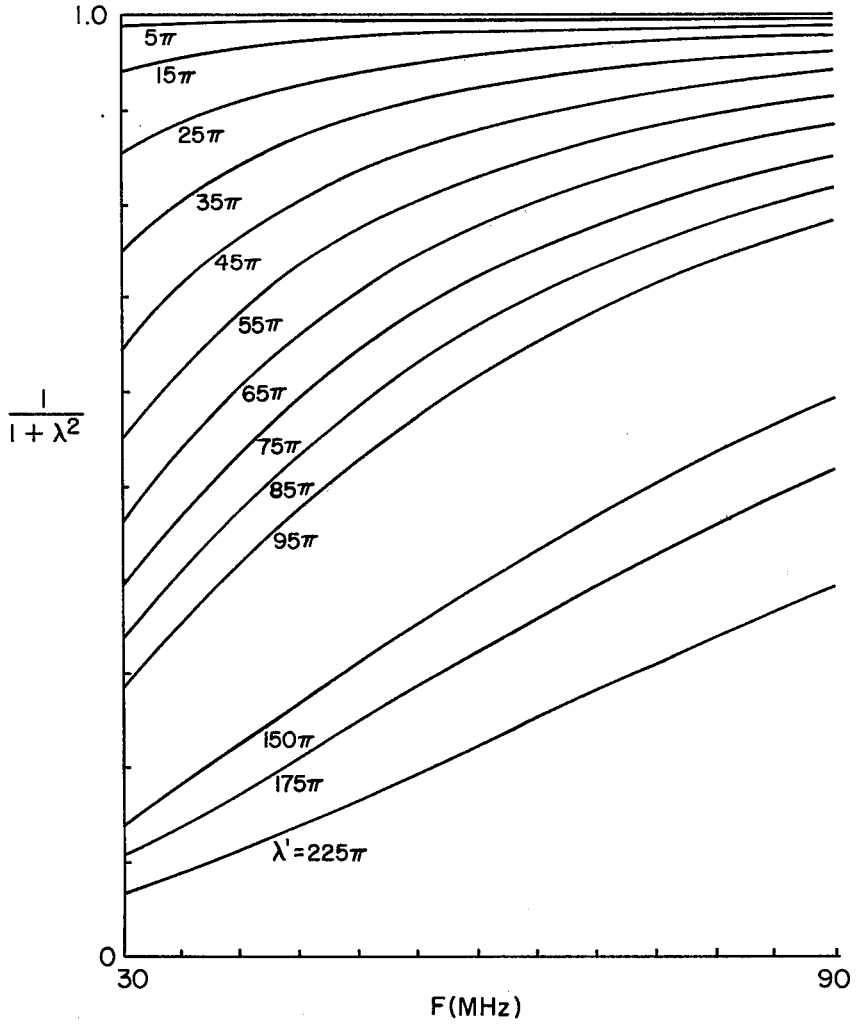
FIG. 2 SERIES RESISTANCE (R–L NETWORK)

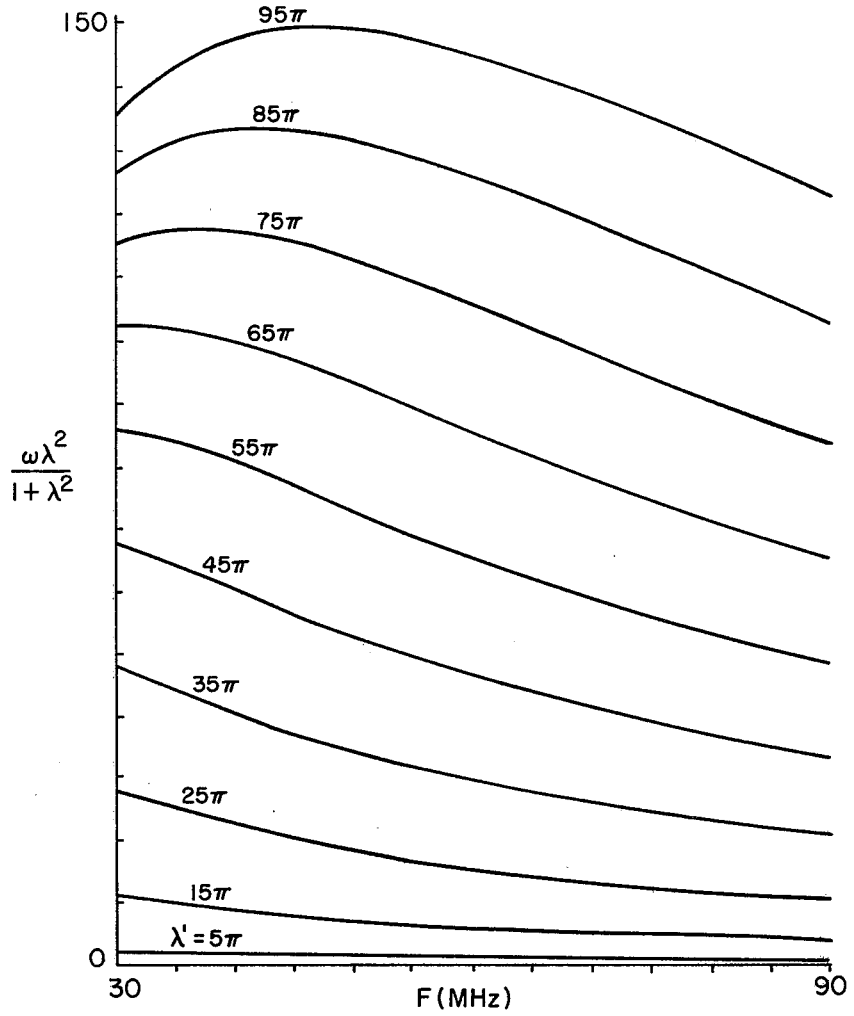
FIG. 3 SERIES REACTANCE, R/L NETWORK
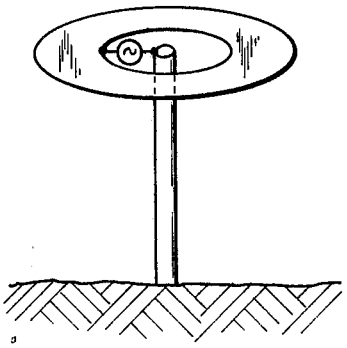
FIG. 4 GROUNDED-BASE, TOP-LOADED ANTENNA
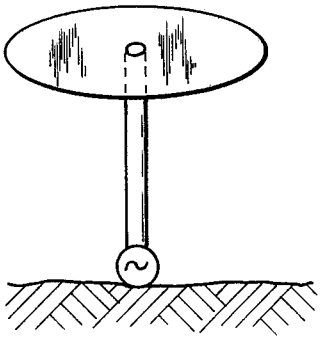
FIG. 5 TOP-LOADED, BASE-DRIVEN ANTENNA FIG. 6 BASE DRIVEN, WIDEBAND MATCHED ANTENNA
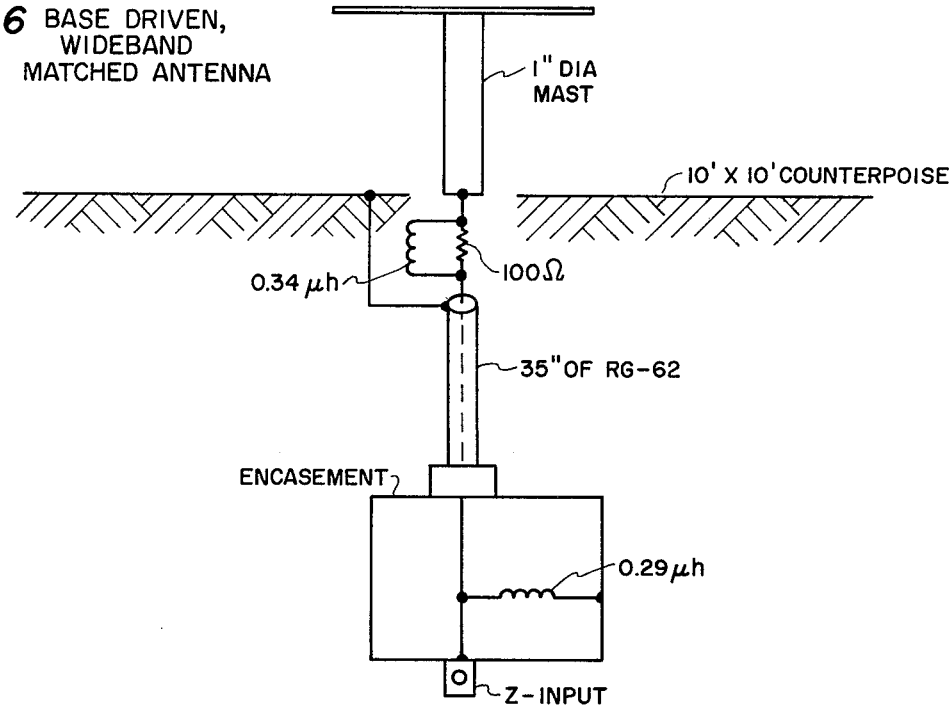
FIG. 8 REACTANCE OF SERIES INPUT L-NETWORK
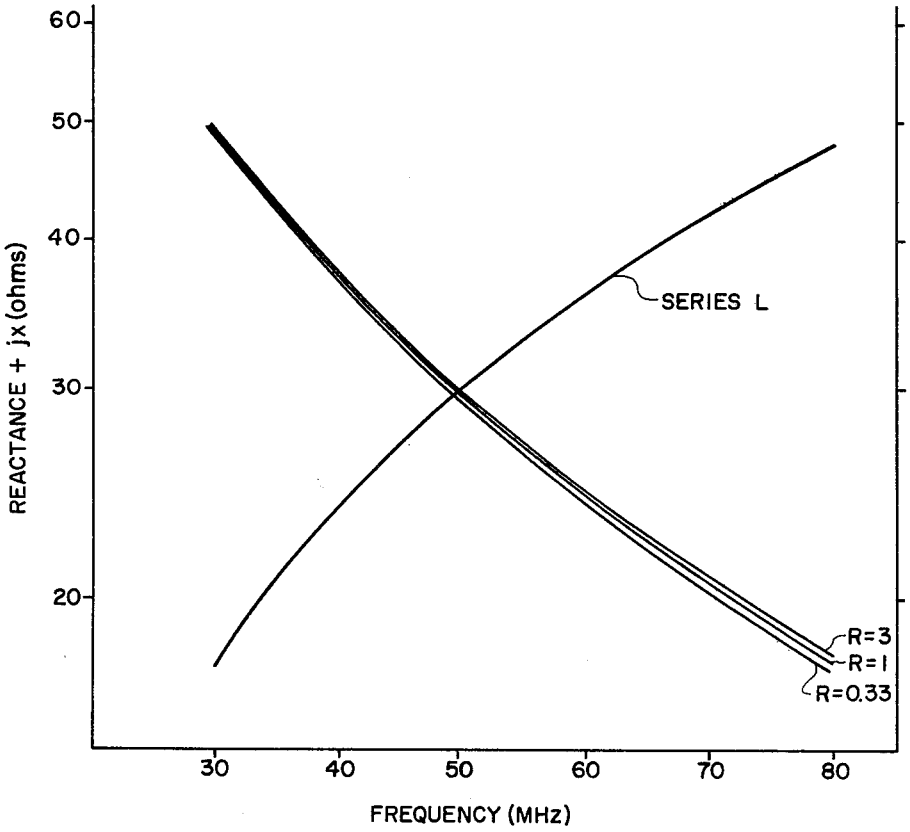

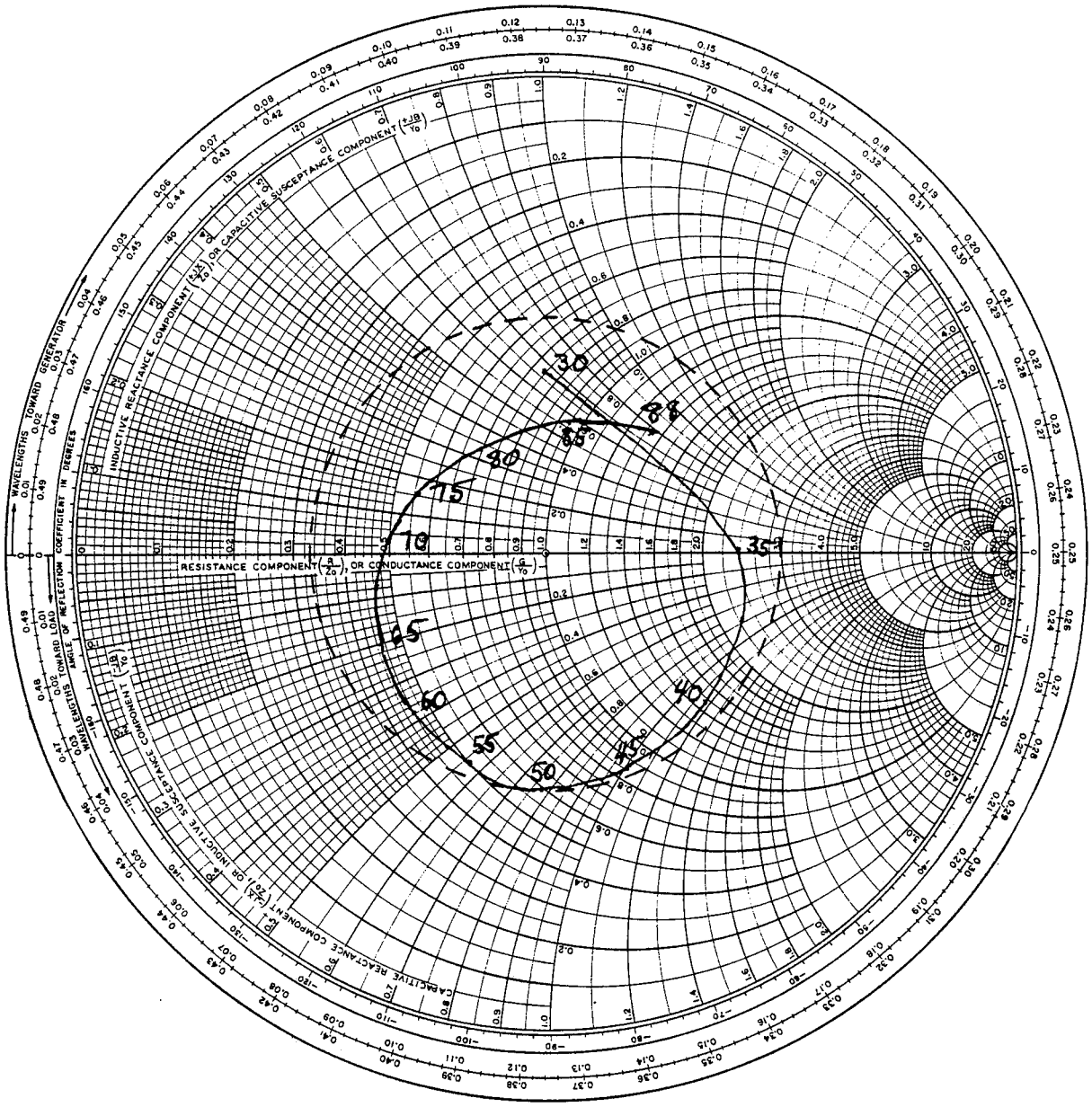
*FIG. 7* INPUT IMPEDANCE OF MATCHED ANTENNA AT VHF.

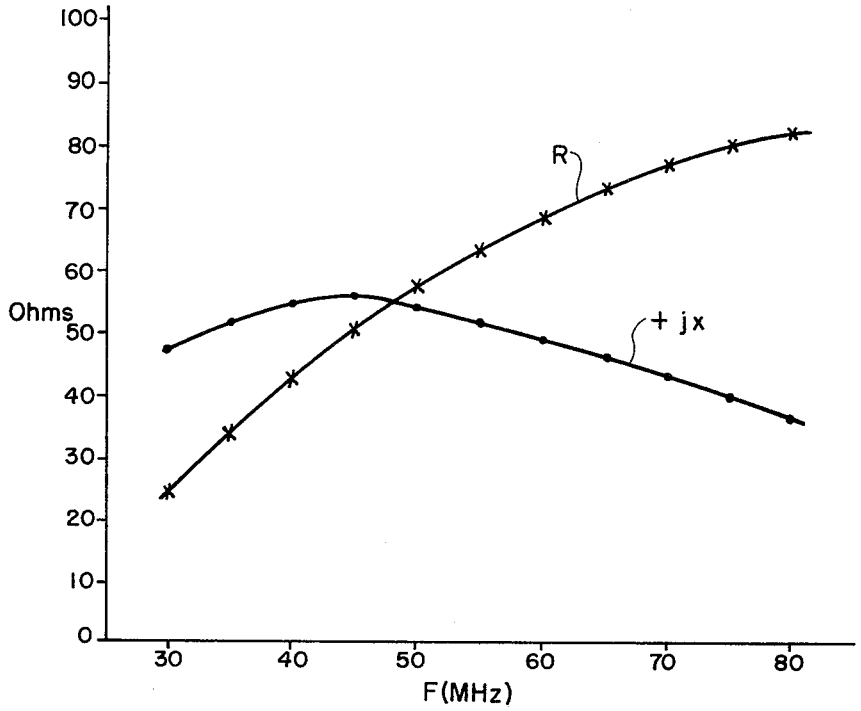
FIG. 9 MEASURED IMPEDANCE vs FREQUENCY
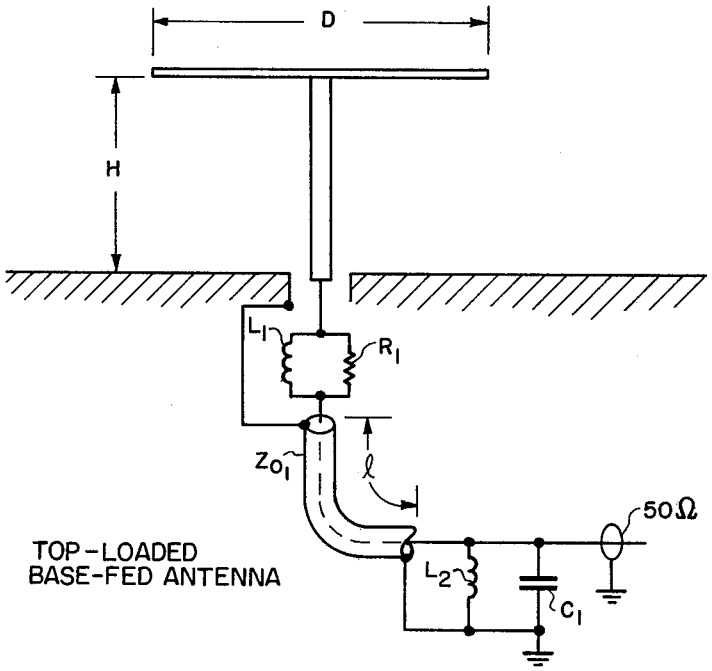
FIG. 10 TOP-LOADED BASE-FED ANTENNA FIG. 11 GROUND BASE TOP-LOADED MONOPOLE
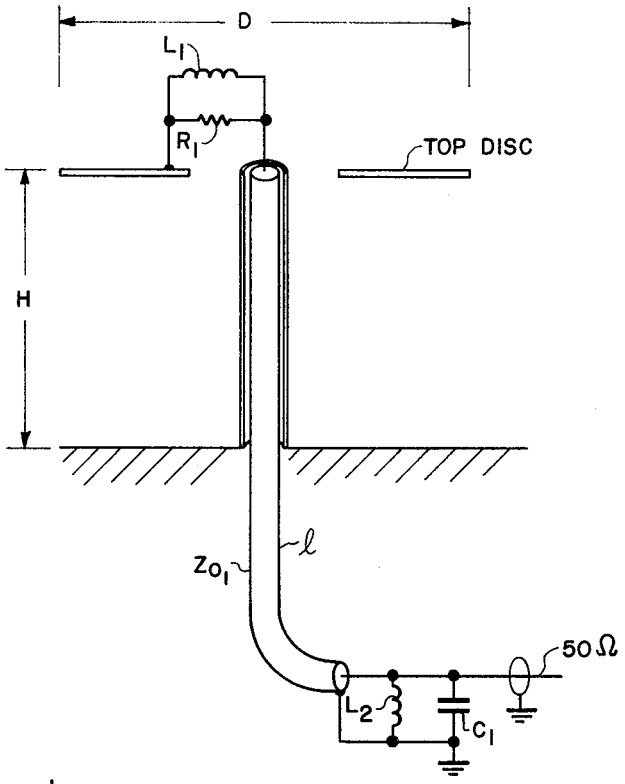
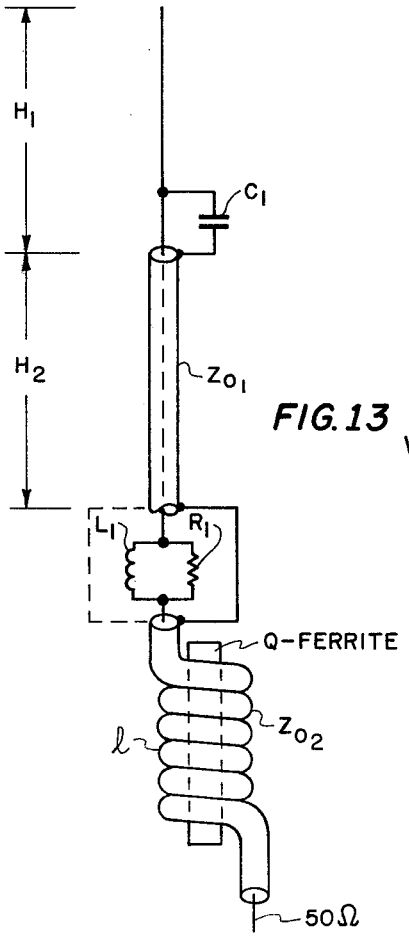
FIG. 13 DIPOLE ANTENNA WITH BASE ISOLATION

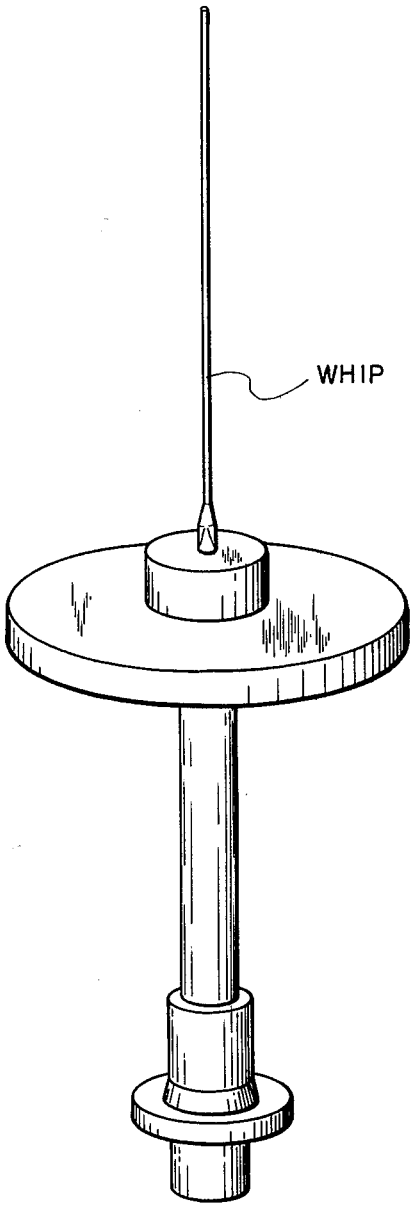
FIG. 12 LOW-PROFILE, BROADBAND, SURVIVABLE ANTENNA WITH BREAKAWAY WHIP.

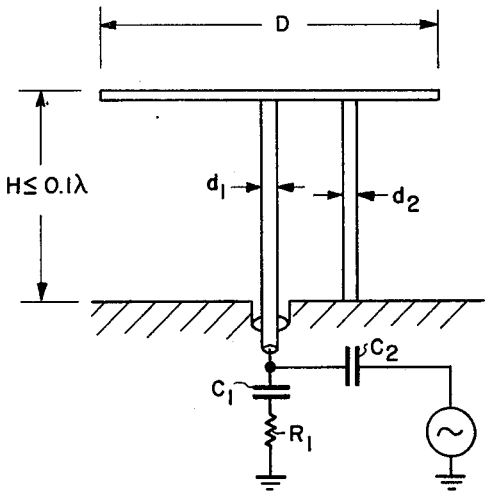
FIG. 14 TOP-LOADED, FOLDED ANTENNA WITH "L"-NETWORK AND REVERSE CHARACTERISTIC NETWORKS.
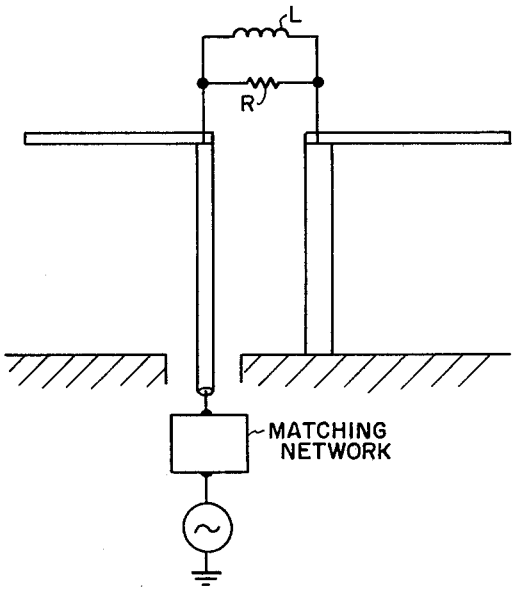
FIG. 15 FOLDED ANTENNA, DISC TOP AND R/L LOADED.
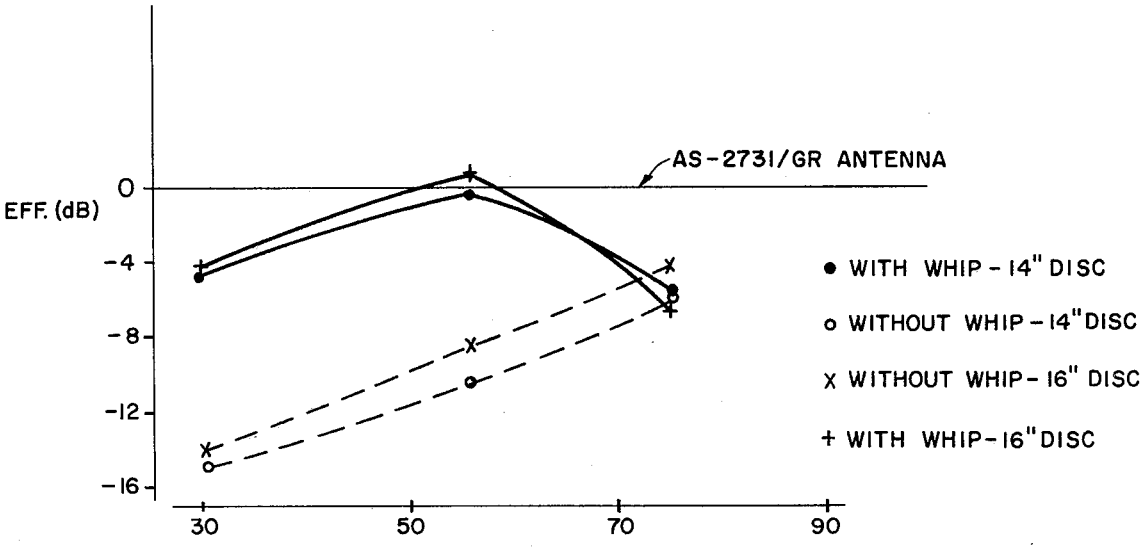
FIG. 16 EFFICIENCY OF SURVIVABLE, LOW PROFILE, ARMOR ANTENNA.

SMALL BROADBAND ANTENNAS USING LOSSY MATCHING NETWORKS

The invention described herein may be manufactured, used and licensed by or for the Government for Governmental purposes without the payment to me of any royalties thereon.

BACKGROUND OF THE INVENTION

This invention relates to antennas with special application to small, top-loaded antennas used in the military for example, for tanks, jeeps, trucks, vans, tactical command centers, helicopters and various aircraft. A serious problem exists for impedance matching these antennas over a wide frequency range. At some frequencies the antenna exhibits a complex impedance with positive imaginary part, while at other frequencies it behaves as a negative imaginary component. To cancel out the imaginary-going portions of the complex impedance, it has been possible to construct compensating circuits to be switched on for use with the antenna. However, these compensators are useful only over a narrow range of frequencies, and a large number of different compensators is needed, each for a particular frequency band. It is noted that the switching array might have as many as 10 positions and needs considerable attention to adjust for whatever frequency happens to be in use.

This invention poses a solution to the desire for a single compensation circuit which would have the correct cancellation properties of any frequency over a wide frequency range, 3:1, e.g. The invention makes use of a novel combination of passive circuit elements which will have the correct theoretical characteristics for these frequencies.

The major factors to be considered in the selection of the design approach to be followed are communication range and physical size of the antenna. At the present time, a height no greater than 24" and a range of at least 6 km with an RF input power level of 2 w, appear to be the design goals. The discovery of the desirable impedance properties of some simple, two-element passive networks, should be useful for a wide class of antennas, from low-profile to half-wavelength dipoles. Due to its broad bandwidth, the antenna is well suited for spread spectrum, FFH, and SNAP applications.

Reference is made to the following related application: "Compact Monopole Antenna With Structured Top Load" by Donn V. Campbell, John R. Wills, and Charles M. DeSantis, Ser. No. 129,969, filed Mar. 13, 1980.

SUMMARY OF THE INVENTION

The invention makes use of R, L and C elements arranged in numerous embodiments such as the series R and C circuit used in parallel with the antenna or the parallel R and L circuit used as a series element with the antenna. Other combinations of resistors with passive L and C elements are envisioned but only those circuits whose imaginary component of immitance is a constant or a decreasing function of frequency, however, are useful, since they have the needed theoretical characteristics to match the antenna over the proposed wide band of frequencies. Various physical arrangements are shown varying the location of the matching circuit and driving source. In one embodiment for instance, the antenna is top-loaded with driven base while in another it is grounded-base and top driven. The addition of a breakaway whip device to the top of the antenna and its effect of approximately doubling the transmission range is noted. The matching needed for various antennas is shown such as for the small folded type antenna, the dipole antenna with base isolation, and the various monopole antenna configurations.

OBJECTS OF THE INVENTION

Accordingly, it is one object of this invention to provide a single circuit for matching an antenna over a broad band of frequencies, without necessity of band switching.

It is a further object of this invention to improve the transmission range of a small antenna device by providing a slender whip extension to its length.

A still further objective of this invention is to provide a matching circuit for a small antenna device which may be constructed from ordinary passive elements and yet which is capable of matching the antenna over a broad, 3:1 frequency range.

The foregoing and other objects and advantages of the invention will appear from the following description. In the description reference is made to the accompanying drawings which form a part hereof, and in which there is shown by way of illustration and not of limitation a preferred embodiment. Such description does not represent the full scope of the invention, but rather the invention may be employed in different arrangements.

DESCRIPTION OF THE FIGURES

FIG. 1A illustrates a parallel resistor-inductor circuit embodiment used to match the antenna device over a broad range of frequencies;

FIG. 1B shows a series resistor-capacitor circuit embodiment used to match the antenna device over a broad range of frequencies;

FIG. 2 shows, as a function of frequency, the resistive or conductive portion of the complex impedance or admittance of the circuit of either FIG. 1A or 1B;

FIG. 3 shows, as a function of frequency, the reactance or susceptance portion of the complex impedance or admittance of the circuit of either FIG. 1A or 1B;

FIG. 4 illustrates a schematic of a grounded-base, top-loaded antenna;

FIG. 5 illustrates a schematic of a top-loaded base-driven antenna;

FIG. 6 illustrates a base-driven small antenna with wide-band matching circuit;

FIG. 7 illustrates the input impedance of the matched antenna as a function of frequency on the VHF band;

FIG. 8 illustrates the required impedance variation of the first element of an "L" matching circuit as a function of frequency for broadband operation as well as the realizable variation for a simple passive element;

FIG. 9 illustrates the complex impedance of a parallel resistor-inductor matching circuit as a function of frequency;

FIG. 10 illustrates a top-loaded base-fed antenna with parallel resistor-inductor matching circuit;

FIG. 11 shows a top-fed grounded-base antenna with parallel resistor-inductor matching circuit;

FIG. 12 illustrates a top-loaded low-profile survivable antenna with breakaway whip;

FIG. 13 illustrates a dipole antenna with base isolation and having a parallel resistor-inductor matching circuit;

FIG. 14 shows a top-loaded, folded antenna with series, resistor-capacitor matching circuit;

FIG. 15 shows a top-loaded, folded antenna, with parallel resistor-inductor matching circuit; and FIG. 16 illustrates the transmission efficiency as a function of frequency, presence of absence of break-away whip, and antenna disc size.

DETAILED DESCRIPTION OF THE INVENTION

Impedance matching of a small dipole or monopole antenna, over a broad frequency range (e.g. 3:1), is ordinarily done through multiple matching circuits, each for a different band of frequencies.

In one VHF antenna in use 10 bands are needed to cover the 30–76 MHz range, and a multi-position switch is employed to connect the appropriate circuit to the antenna for the desired frequency sub-band. The complexity of the circuitry, the switch, and the need in most cases for remote control make the design very costly and difficult to adjust and maintain and vulnerable to damage. However, there does not seem to be an alternative if maximum efficiency is the primary goal, because an antenna that is $<\lambda/2$ at all operating frequencies will have an impedance variation which cannot be matched (using L-C circuits only) over a 2:1 or 3:1 frequency range in a single band.

One other characteristic of the antenna involves the current distribution along the radiating element. If the antenna is $<\lambda/2$, the current distribution will tend to be linear. The shorter the antenna, the smaller the maximum amplitude of this current becomes for a given driving voltage. The effect of this on the impedance is a reduction in the real part and an increase in the negative imaginary part, and, hence, the antenna becomes a poorer radiating element.

If a capacitive disc is added at the ends of the short antenna, the current distribution tends to improve, to become more constant over the length of the antenna, as the frequency is varied. This effect is very beneficial in reducing the range of variation with frequency of the input impedance. In addition, the radiation efficiency of the antenna will improve substantially. The impedance variation, however, is still too large to accomplish single band coverage using L-networks only.

Note that everything which has been said about the dipole applies equally to the monopole antenna (half of a dipole) fed or driven against a ground plane. Some of the configurations to be described are monopole antennas.

To sum up, what is needed for broadband operation of an antenna, particularly a short antenna, is a network which compensates, over a broad frequency range, for the antenna reactance and transforms the antenna resistance to that of the generator or load (receiver) connected to the antenna. In most cases, the compensating reactance (or susceptance) must decrease with frequency, a variation opposite to that produced with a simple capacitor or inductor.

The input or feedpoint impedance of a small monopole antenna is characterized by a large negative reactance and a very small resistance. To resonate the antenna, the oppositely-signed, equal-magnitude, reactance is needed. Over a broad frequency range, this compensating reactance must decrease with frequency. Provided that resistive loss is allowed in the matching network, it has been found that the simple networks shown, for example in FIGS. 1*a* and 1*b* possess very desirable reactance (susceptance) characteristics for matching and loading small antennas.

In particular, the impedance of the R/L circuit is:

$$Z = R.\left(\frac{1}{1+\alpha^2}\right) + jL.\left(\frac{\omega\,\alpha^2}{1+\alpha^2}\right)$$

where

R=resistance in ohms.

L=inductance in henries, $\omega=2\pi f$, where f=frequency in Hertz, and $\alpha \triangleq R/\omega L$.

Plots of the terms in parenthesis in the impedance equation as a function of frequency are shown in FIGS. 2 and 3 with the ratio R/L as the parameter. The maximum change (decrease) in the reactive component occurs for the parameter range from $25\pi$ to $35\pi$. In this range, the real component is a slowly increasing function with frequency. In a short monopole antenna, the R/L circuit at low frequencies compensates for some of the reactance of the antenna while adding a small resistance to aid in matching. At the high frequency end of the band, the inductive reactance of the R/L circuit is minimized, which is desirable, since the electrical size of the antenna is increasing with frequency and the required reactive compensation is decreasing. Although the resistive component has increased, the radiation resistance of the antenna is also increasing with frequency, so that the radiation efficiency is not severely degraded, i.e., it is nearly matched.

For the R-C circuit shown in FIG. 1*b*, the same considerations apply in a discussion of the circuits' admittance variation, i.e., $$Y = G.\left(\frac{1}{1+\delta^2}\right) + jC.\left(\frac{\omega\,\delta}{1+\delta^2}\right)$$

where

G=conductance in mhos

C=capacitance in farads, and $\delta \triangleq G/\omega C$.

The R-C circuit would be especially useful in small antennas, such as loop antennas and small folded antennas. The curves of FIGS. 2 and 3 are still applicable. (Note that $\alpha \equiv \delta$ numerically.)

FIGS. 4 and 5 illustrate conceptually a grounded-base top-driven top-loaded antenna and a base-driven, top-loaded antenna.

As an example of the use of the R/L network to load a small antenna, reference is made to the antenna shown in FIG. 6. The antenna is only 18" tall; it is fed at the base of the vertical element, and has a 14" diameter, metal top disc. FIG. 7 shows input impedance of the matched antenna in FIG. 6 as a function of frequency in the VHF band. As part of the matching to a VSWR within 3:1 over the 30 to 88 MHz band, a section of high impedance coaxial line and a single element parallel L network were also added. Only one band was needed, and the radiation efficiency of the antenna was not completely sacrificed for the sake of bandwidth. If it is possible to include a switch, which requires operator intervention of course, a two or four band antenna could be designed with the networks optimized for each band. However, the gain in efficiency is a very slowly increasing function with the number of bands, and so the added complexity, manufacturing costs, and alignment difficulties associated with bandswitched antennas might be too unattractive when compared to the improvement achieved.

The basic antenna is a top-loaded, vertical monopole. The top loading is provided by a disc, and the RF drive can be applied either at the base of the vertical element or, alternatively, at the junction of the vertical element and the top disc.

The top load structure of this invention comprises a disc made in one embodiment of aluminum. The top load is typically ⅛" thick, though other thicknesses, of armour plating, might be chosen to withstand battle conditions. The vertical element is typically a hollow steel tube, though other types might be used. The dielectric material may be fiberglass, teflon, lucolux, or KEVLAR materials, for example. The height of the antenna might be as low as 1/20λ(of a wavelength). It is noteworthy how so short an antenna (perhaps 18") may replace what for this frequency range and required transmission range, is being accomplished by a large, 6 to 10 foot antenna, being both bulky and vulnerable to damage. The antenna's height may further be reduced by broadening the diameter of the vertical element. The effective impedance of the antenna, being understood as change in displacement current with respect to ground, is thereby increased. The height might be shortened without increasing the diameter of the vertical element, but more stringent matching circuits would then be required and transmission range would be sacrificed. One way to shorten the antenna for these frequencies has been shown; that is by provision of the top load structure and base plane. A further improvement in range for the same sized antenna is achieved by feeding the antenna at the junction of the top loaded structure and vertical element or better by feeding the antenna on the extremities of the top load element itself. The feed line is coaxial cable which might be standard RG-58, flexible or rigid, which in one embodiment is fed through the hollow vertical member to reach the top load. The matching circuit and associated elements are typically mounted in a grounded metal case into which an input connector is installed. The input signal which must be accommodated typically has an impedance of 50Ω. The matching circuit of this invention, also to be especially noted, needs no tuning over the entire 3:1 approximate band. This is quite beneficial for the needs of military personnel. Two types of commercially known small broadband antennas come to mind, but it is to be noted that each depends on some tuning. Noted are a Continuously-Tuned Capacitive Top-Loaded Monopole Antenna and a Continuously-Tuned Inductive Folded Monopole. Although these devices might not depend on operator intervention for tuning purposes as with this invention, the devices nevertheless depend upon an intricate automatic adjustment done internally. The input impedance of the antenna is continuously monitored over frequency and other changes, and matching is tuned automatically for errors. The involved automatic correction subsystems are completely eliminated by this invention which inexpensive by comparison, requires only simple resistors, capacitors, and/or inductors. This simple matching network avoids all the monitoring and correctional circuitry and is hence more reliable, simple and inexpensive of maintenance and construction.

Models of antennas with both types of feed have been constructed with the following physical dimensions:

Height = 18"
Disc Diameter = 14" or 16"
Diameter of Vertical Element = 3"

In matching, the R-C circuit is equally useful to a wide class of antennas, particularly loops and short folded antennas. It is emphasized that the reverse slope reactance and susceptance characteristics are producible in a wide variety of circuits consisting of R, L's, and C's in combination. The two element networks discussed in this disclosure seem to have the most useful variations for small antennas; but the other circuits may have greatest utility for larger antennas where the imaginary part of the impedance changes sign once (or several times) over the desired frequency range. However, attention is only focused on those R-L-C circuits which do display either a decreasing positive reactance with frequency and/or decreasing positive susceptance with frequency.

Applying the RLC circuits containing Resistors to Antennas

In the reactance vs. frequency curves shown in FIG. 8, the curves marked R = 3, 1, or 0.33 represents the required reactance variation of a series input L-network to match an uncompensated 0.1λ high monopole antenna to within a VSWR = 3:1 over the 30–80 MHZ frequency range. The curve marked "series L" is the variation in reactance to be expected from a practical coil. It is easily seen that the instantaneous bandwidth achievable using this practical coil is extremely small, being just that resulting from the intersection of the two sets of curves. (The second element of the L-network does not restrict the achievable band-width.)

FIG. 9 shows the variation with the frequency of an R/L circuit consisting of six 560Ω, 2 W carbon resistors (in parallel) and an air-core coil of ~0.34 μh inductance, carefully measured on a Wayne-kerr Admittance bridge. It is essentially as predicted by the curves in FIGS. 2 and 3. This is the R/L network that was used in the antenna shown in FIG. 6. It is worth noting, once more, that this simple R/L circuit possesses a decreasing inductive reactance with frequency, and that this feature is a great aid in matching the antenna with frequency.

Referring again to FIG. 9, it will be seen that the reactance variation shown in FIG. 8 more closely approaches the required variation. In practice, the comparison is even better because the resistance added by the R/L network (as seen in FIG. 9) tends to "flatten" the required reactance variation. (This "flattening" is caused by a reduced demand on the L-network for large transformation-ratios). The L-Network, of course, is only one way in which to exploit the desirable features of the R/L and R-C networks.

Practical, Broadband Antennas of Reduced Size

A possible and realizable antenna is shown in FIG. 10, a top loaded monopole antenna fed at its base. A version of this antenna was constructed with the following dimensions and component values:

D = 14"
H = 18"
l = 0.2λ at 70 MHz
$Z_{01}$ = 75 ohms
L1 = 0.34 μh
R1 = 100μ
L2 = 0.29 μh
C1 = (variable of pf. for final adj.)

From the measured impedance of this antenna, it was observed that the antenna is matched to within a 3:1

VSWR over the 30–88 MHz range in one band. A second version of this antenna is shown in FIG. 11. In this case, the feedpoint is raised to the junction between the disc and vertical post. This arrangement provides a measure of mechanical integrity in a hostile environment. In a single band impedance matching is achieved for an antenna with the following parameters and components.

D=16″
H=18″
l=0.25λ@70 MHz
$Z_{01}$=75 ohms
L1=0.34 μh
R1=96Ω
L2=0.18 μh
C1=47 p f. (variable for final adj.)

An interesting and unique feature of these antennas is that by adding a 4.5′ to 6′ whip section to the top of the antenna, the useful communication range can be doubled with no changes required in the matching circuitry. A prototype of such an antenna (which was range tested) is shown in FIG. 12. This particular model has only a 14″ disc top load and is tuned in one band. It is designed for ruggedness. The break-away whip feature insures continuous communications, i.e., if the whip is destroyed, the antenna continues to operate as a low-profile antenna. To return the extended range performance, a new whip is simply screwed in.

The antennas discussed so far have been small compared to a wavelength, i.e. 0.1λ or less in the operating frequency range. The R-L and R-C as well as other networks with the reverse impedance characteristic are also useful for somewhat larger antennas of the type shown in FIG. 13. This antenna is essentially a dipole antenna with a device called a cable choke at its base. The cable choke serves to isolate the antenna from its mounting platform so that radiation patterns of the antenna will be independent of mounting. The design procedure for these chokes is known in the literature. Note, however, that the core material of the choke is ferrite. Usually, a Q2 ferrite core material is used in the VHF range, but a successful choke for the VHF range has also been made using Q1 material. A particular set of dimensions yielding a one band VHF antenna are as follows:

H1=42″
H2=28″
C1=10 p f (This capacitor may be removed if the antenna upper section is lengthened.
L1=0.34 μh
R1=30 ohms
$Z_{01}$=125 ohms
l=0.12λ@30 MHz
$Z_{02}$=75 ohms
Core Material="Q1"

Other arrangements of the network elements are possible, of course. The R/L network could be placed at the feed point or loading at other points along the antenna using these reverse characteristic networks. The antennas just described are only some of the possible configurations which benefit from using the reverse characteristic networks. For example, consider the configuration of FIG. 14. This is a small folded antenna with a top load matched over a broad band of frequencies using an R-C element and a simple C.

Another possible folded antenna configuration is shown in FIG. 15. In this design, the R/L network is connected between the two vertical elements of the folded antenna. These vertical elements are, in turn, terminated in top discs (or sections of top discs). The purpose of the R/L network, in this case, is to provide the proper reactance, over a broad frequency range, to insure that the currents in the vertical elements remain in phase with one another (or nearly so). The added resistance simplifies the matching requirements. The top discs aid in reducing the required compensating reactance.

The above few exemplary embodiments have been presented to show the utility of the R/L and R-C networks for loading and/or matching small antennas to sources or sinks over a broad frequency range.

The efficiency of these antennas (in the VHF range) should be given very accurately by the following equation:

$$N(\%) = \frac{R_A}{R_A + R_L} \times 100$$

where RA=radiation resistance of the basic antenna; and $R_L$ includes the loss of the added resistance element in the R/L network, and the losses in the coils, capacitors, transmission lines, and conductors. In FIG. 16 the efficiency is compared, at three frequencies, to a standard VHF antenna. Range measurements are shown below the efficiency curves, with and without the breakaway whip section.

What is claimed is:

1. A broadband small vertical manopole top-loaded, top-fed antenna unit topped by a flat capacitive disc at one point of which disc is connected the antenna feed signal through a series matching circuit, said top-matching circuit for impedance matching the antenna over a broad frequency range, the circuit comprising one or more resistors and one or more inductors.

2. The antenna unit of claim 1 wherein the circuit comprises an inductor in parallel with a resistor and the elements are selected so that circuit reactance is a decreasing function of frequency.

3. The antenna unit of claim 2 further including a base matching circuit.

4. The antenna unit of claim 3 wherein the base matching unit comprises an L-C network.

5. The antenna unit of claim 1, 2, 3 or 4 wherein the said range of frequencies is at least substantially three to one.

* * * * *